US007062871B1

(12) United States Patent
Smidt

(10) Patent No.: US 7,062,871 B1
(45) Date of Patent: Jun. 20, 2006

(54) STOWABLE IRONING BOARD INSTALLATION PROVIDING INCREASED STORAGE CAPACITY

(75) Inventor: Reginald R. Smidt, Morton, IL (US)

(73) Assignee: Iron-A-Way, Inc., Morton, IL (US)

( * ) Notice: Subject to any disclaimer, the term of this patent is extended or adjusted under 35 U.S.C. 154(b) by 0 days.

(21) Appl. No.: 10/905,923

(22) Filed: Jan. 26, 2005

(51) Int. Cl.
*D06F 81/06* (2006.01)
*A47B 81/00* (2006.01)

(52) U.S. Cl. ..... 38/104; 38/137; 312/26; 248/685; 108/35

(58) Field of Classification Search ..... 38/112, 38/137, 138, 139, 106, 107, 104; 108/33, 108/47, 48, 37, 39, 94, 35; 312/26, 237, 312/305; 248/695
See application file for complete search history.

(56) References Cited

U.S. PATENT DOCUMENTS 1,632,939 A * 6/1927 Williams ..... 108/37
1,833,997 A * 12/1931 Keebler ..... 108/39
1,888,114 A * 11/1932 Dunkin ..... 108/33
1,960,143 A * 5/1934 Rubin ..... 108/33
2,693,989 A * 11/1954 Santana et al. ..... 312/305
3,185,278 A * 5/1965 Miller et al. ..... 194/241
3,663,080 A * 5/1972 Ayers ..... 312/237
4,480,556 A * 11/1984 Wilson et al. ..... 108/48
4,909,158 A 3/1990 Sorensen
4,961,388 A 10/1990 Simpson
4,995,681 A 2/1991 Parnell
5,452,531 A 9/1995 Graville et al.
5,709,044 A 1/1998 Atapattu
5,778,573 A 7/1998 Nottingham et al.
6,089,167 A * 7/2000 Frohardt ..... 108/94
6,253,472 B1 7/2001 Gast

OTHER PUBLICATIONS

CAD drawings "LH V6 BRK-Angle" and "RH V6 Brk-Angle", showing left hand and right hand angle brackets for use as bottom brackets of a height-adjustable ironing board installation, on sale at least as early as 1973.
CAD drawing "Bracket-Side", showing a bracket for use as brackets of a height adjustable ironing board installation, on sale at least as early as 1973.

(Continued)

*Primary Examiner*—Ismael Izaguirre
(74) *Attorney, Agent, or Firm*—Marshall, Gerstein & Borun LLP

(57) ABSTRACT

A stowable ironing board installation in a cabinet system provides increased storage capacity within the associated cabinet system by minimizing the volume of dead space. The ironing board installation may include a frame of a shallow height substantially shorter than the length of the ironing board when in a substantially upright, stowed position. When at least one shelf of a depth that allows clearance for the ironing board in front of the shelf when the ironing board is in the substantially upright, stowed position is installed over the frame, objects may be stored within the cabinet system on such at least one shelf. To enhance access to the usable storage area behind the stowable ironing board, installations are disclosed wherein the ironing board may be swiveled to an orientation other than perpendicular, in a horizontal plane, to the front of the cabinet system.

3 Claims, 15 Drawing Sheets

OTHER PUBLICATIONS

Assembly drawing of Iron-A-Way Model "Ne-242" swiveling ironing board installation, on sale at least as early as 2003.

Assembly drawing of Iron-A-Way Model "Ne-242" ironing board installation (non-height adjustable and non-swiveling), on sale at least as early as 1989.

Assembly drawing of Iron-A-Way Model "A-42" ironing board installation (with swivel and height adjustability), on sale at least as early as 1989.

Assembly drawing of Iron-A-Way Model "A-46" ironing board installation (with height adjustability), first offered for sale Jan., 1973.

CAD drawing "Bracket-Pivot", showing a bracket for use with a pivoting ironing board installation, on sale at least as early as 1989.

CAD drawing "SWVL. Bracket", showing a side bracket for use on a swiveling, non-height adjustable ironing board installation, on sale at least as early as 1985.

Whirlpool™ ImPress™ Ironing Station—Family Studio products page; product information sheet; digital photo; (A1b) Use & Care Guide; and (A1c) Installation Instructions—First sale at least as early as Nov., 2002.

Häfele at Cabinet Accessories Unlimited, Stratford, CT—Built-In Ironing Boards—Fold Away Ironing Board (Cat. No. 568.65.990)—Understood to be on sale at least as early as Dec., 2003.

Häfele at Cabinet Accessories Unlimited, Stratford, CT—Built-In Ironing Boards—Ironifix™ built-in ironing board (Cat. No. 568.60.710)—Understood to be on sale at least as early as 1988.

Häfele at Cabinet Systems Unlimited, Stratford, CT—Ironing Board for Wall Mounting (Cat. No. 568.66.700)—Understood to be on sale at least as early as Dec., 2003.

Closet Valet by A & G Concepts International, LLC—Closet Ironing Center—Understood to be on sale at least as early as Jul., 2001.

Handi-Press® Ironing Centers—Model SM-42-1000 product information sheet—Understood to be on sale at least as early as 1989.

Handi-Press® Ironing Centers—Model NE-400-1000 product information sheet—On sale since 1987.

Handi-Press® Ironing Centers—Model XL-44-1000 product information sheet—On sale at least as early as Oct., 1998.

Iron-A-Way Built-In Ironing Centers catalog, showing models A-46 (first offered for sale Jan., 1973); A-42 (on sale at least as early as 1989); E-342 (on sale at least as early as 1973); and NE-342 (on sale at least as early as 1973); and NE 242 (on sale at least as early as 1989).

The Bonzer Board Company—Product brochure page and Specifications sheet for "The Bonzer Board" (on sale at least as early as 1989).

* cited by examiner

STOWABLE IRONING BOARD INSTALLATION PROVIDING INCREASED STORAGE CAPACITY

FIELD OF THE DISCLOSURE

This disclosure relates generally to stowable ironing boards and, more specifically, to stowable ironing board installations in cabinetry, such as solid shelving systems, that minimizes dead space so as to provide increased storage area behind the stowed ironing board for clothing, readily accessible ironing and other laundry-related supplies, jewelry, or anything that is otherwise placed on shelves or in cabinets.

DESCRIPTION OF THE PRIOR ART

Stowable ironing boards are well known amenities for residential and institutional use. They offer space-saving convenience by stowing ironing boards in a generally upright, out-of-the-way position when not in use. With the proliferation of custom closets and cabinetry, there is an increasing demand for closet and cabinet accessories which maximize storage capacity. While it has been known to provide stowable ironing boards in existing closets and cabinet systems, a large volume of dead space is sacrificed with existing stowable ironing board installations.

For example, stowable ironing board systems available from Iron-A-Way, Inc., of Morton, Ill., the assignee of the present disclosure, are installed with mounting and storage frames of shallow depth extending greater than the length of the ironing boards. The ironing boards are folded upright, into the rear-walled frame, when not in use. When installed in a cabinet system, the frame occupies a "footprint" of the cabinet having a width greater than the width of the ironing board, the latter typically at least about 12 inches, and a height of at least 48 inches. The area behind the frame once mounted in the cabinetry or shelving system is rendered unusable dead space, as it is thus blocked from use for storage, effectively sacrificing storage space extending to the full depth of the cabinetry. This is particularly disadvantageous in living units of small size, where available storage space is limited to begin with. In existing models of stowable ironing board systems available from Iron-A-Way, Inc., the stowable ironing boards can be swiveled when in a substantially flat orientation, can be height-adjustable, or both. However, all such existing models have heretofore been mounted only in cabinet-type frames extending the entire height of the ironing board when stowed, thereby preventing access to any potential storage areas behind the stowable ironing board installation.

Other ironing board mounting systems are designed so that the ironing board is not only folded upright when not in use, but also stowed sideways, such that the transverse width of the ironing board is perpendicular to the front of the associated cabinet system. While such a mounting system reduces the overall running width of the footprint across the front of the cabinetry or closet-space dedicated to the ironing board, the mounting system requires at least one dedicated vertical surface (such as wall-space or a closet divider), extending depth-wise to the full extent of the closet or other cabinetry, to support and store the ironing board. Thus, potentially available storage space which might otherwise be occupied by shelving or by a hanger rod is utilized solely for ironing board storage.

BRIEF DESCRIPTION OF THE SEVERAL VIEWS OF THE DRAWING

FIG. 13 is a front perspective view of a variation of the first embodiment of a stowable ironing board installation shown in FIGS. 1 and 2, wherein the stowable ironing board is mounted directly into a cabinet system without the use of a frame, with the ironing board shown in a substantially upright, stowed position;

FIG. 16 is a front perspective view, broken away, of a fourth embodiment of a stowable ironing board installation, with the ironing board and its support structure removed for clarity.

DETAILED DESCRIPTION OF THE PREFERRED EMBODIMENTS

Figure 1:
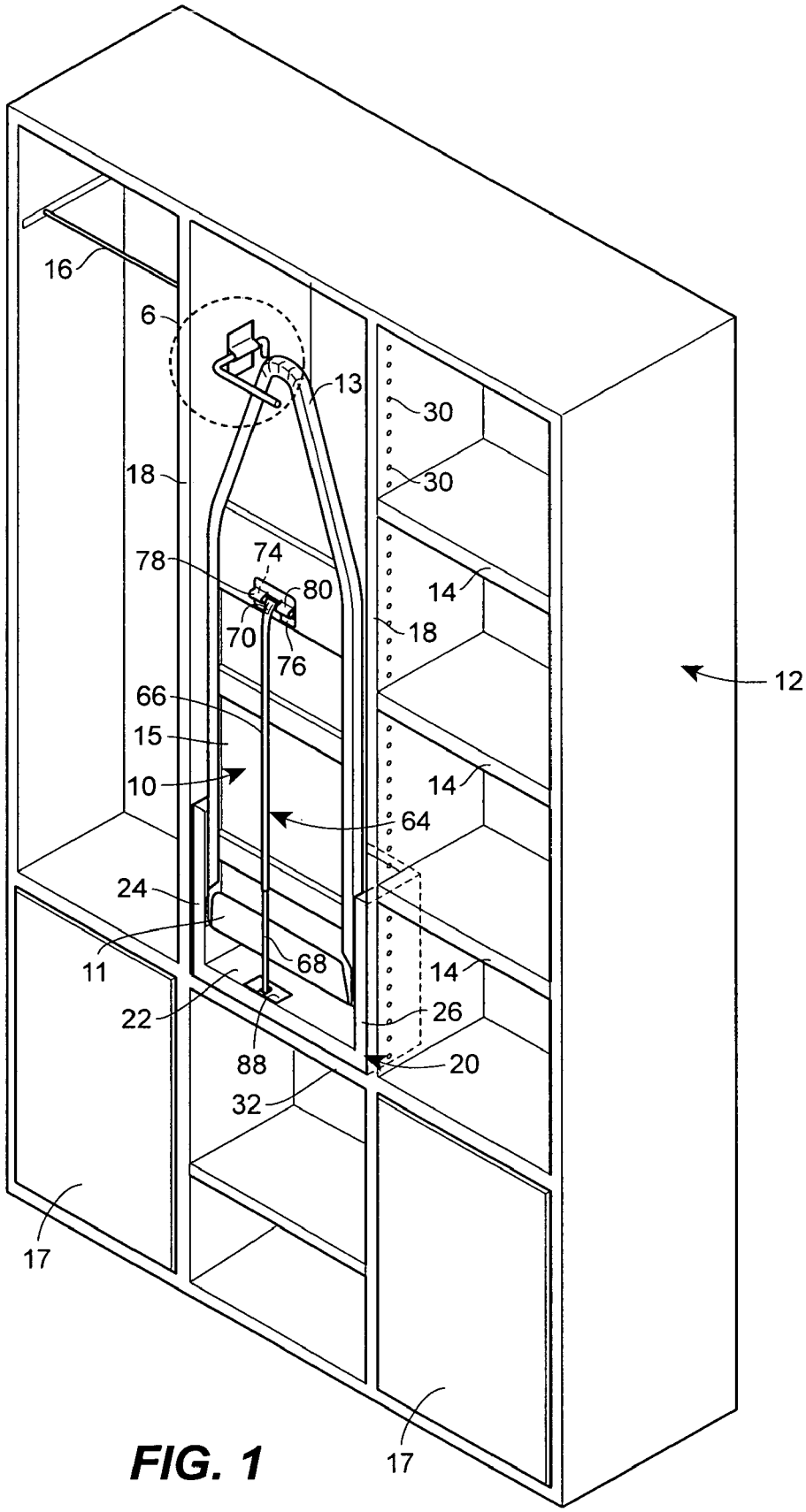
FIG. 1 is a front perspective view of a first embodiment of a stowable ironing board installation in a cabinet system, with the ironing board shown in a substantially upright, stowed position.

A first embodiment of a stowable ironing board installation according to the present disclosure is shown in FIGS. 1–7. In FIG. 1, an ironing board 10 is shown in a substantially upright, stowed position within a cabinet system 12. While the length of the ironing board 10 may vary without departing from the scope of the present disclosure, all of the embodiments disclosed herein may be employed with ironing boards having such lengths as 42 inches and 46 inches, by way of example only. The cabinet system 12 may include shelves 14, a hanger bar 16 of fixed length or expandable length, doors 17, or other storage compartments. The cabinet system 12 also includes vertical panels 18. The cabinet system 12 may, but need not, be located in a closet. In this embodiment, a frame 20 is provided for securement of the ironing board 10 within the cabinet system 12. The frame 20 includes a base plate 22, sidewalls 24, 26, and a rear wall 28.

The frame 20 is particularly well suited for installation within a cabinet system 12 having pre-drilled holes 30, i.e. a cabinet system formed so as to facilitate custom positioning of shelves 14, such as ready-to-assemble shelving systems made of wood, laminates, melamine or thermo-foil coated medium density fibercore (mdf) composite material, or the like. Such systems are generally known as "32 mm systems" based on the center-to-center spacing of the pre-drilled holes 30, which holes are of a suitable diameter to receive shelf support pins. Also common are 1¼inch (31.75 mm) center-to-center hole spacings. Such 32 mm systems are often sold by mass merchants, or installed by carpenters or other custom closet organizer specialists.

It has been found that a suitably sized frame 20 has overall dimensions of a 15 inch width, 12-⅞ inch *height*, and 3½ inch depth. However, other sizes of frame 20 can also be used, depending on a given application and use. When installing a frame 20 having these dimensions, the two vertical panels 18 between which the frame 20 is to be installed are to be spaced 15 inches apart. If the frame 20 is to be installed in a pre-constructed cabinet system 12 between vertical panels 18 spaced more than 15 inches apart, it may be necessary to shim the outside of each of the sidewalls 26 of the frame to take up the space between the sidewalls 26 and the vertical panels 18, so as to best stabilize and support frame 20.

A lower shelf 32, preferably permanently mounted, should be positioned in the cabinet system 12 between the vertical panels 18 at a height approximately 6 inches below the desired height of the ironing board surface when in an extended position for ironing. Thus, if the desired ironing board height when ironing is 36 inches, the lower shelf 32 should be installed so that its top surface is approximately 30 inches from the floor. The frame 20 is positioned to rest on, and be supported by, the lower shelf 32. An upper shelf 34, having a front face 35 recessed at least approximately 2¾ inches from a front of the vertical panels 18, but preferably recessed less than the overall depth of the frame 20, is positioned between the vertical panels 18 at a distance above the permanent shelf 32 at least as much as the height of the frame 20. Once the frame 20 is installed on the lower shelf 32 and between the vertical panels 18, a bottom of the upper shelf 34 is positioned on the frame 20.

Figure 2:
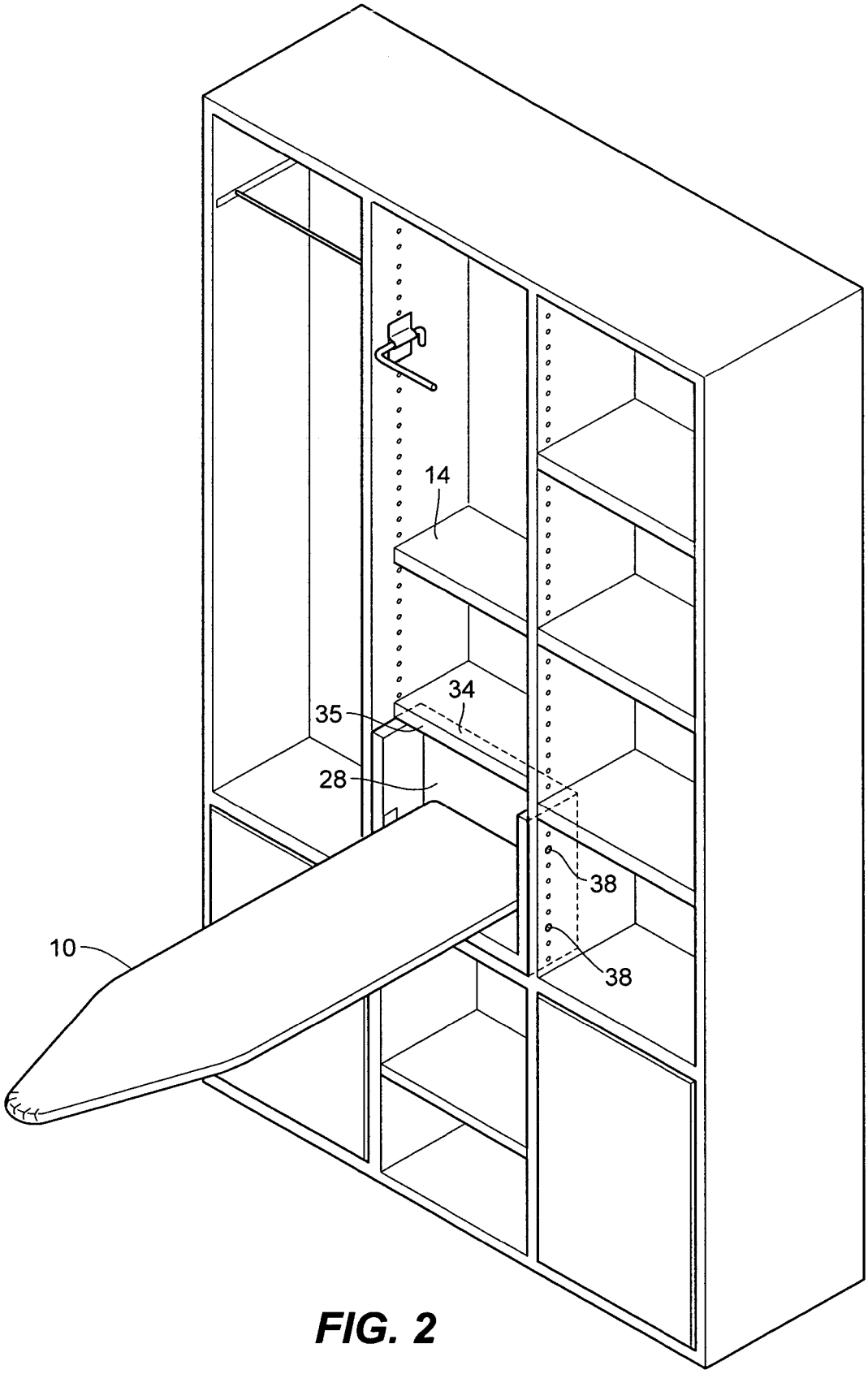
FIG. 2 is a front perspective view of the stowable ironing board installation of FIG. 1, with the ironing board shown in a substantially flat position.
Figure 3:
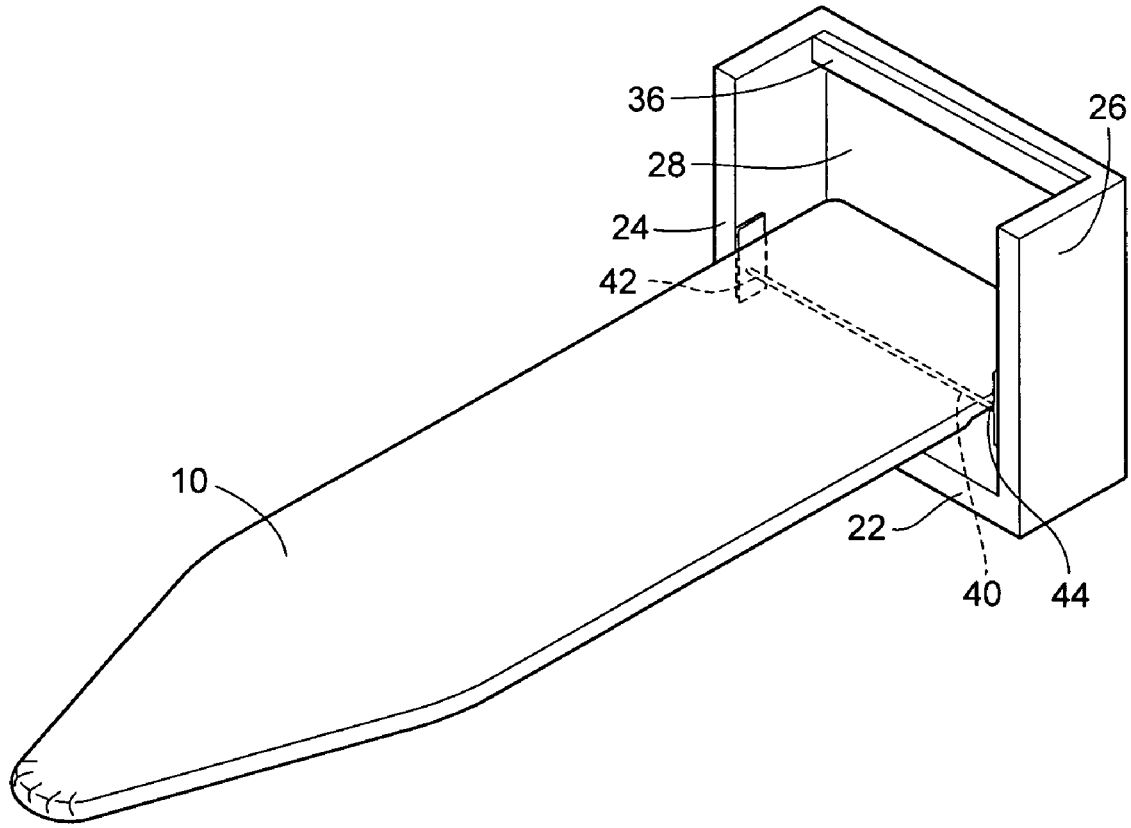
FIG. 3 is a front perspective view of the frame and ironing board for the ironing board installation of FIGS. 1 and 2.

As shown in FIGS. 2 and 3, the frame 20 may be provided with a cross-member or cleat 36 at a top portion thereof. The cleat 36 is preferably positioned such that it is flush with the tops of the sidewalls 24, 26. However, if the cleat 36 is provided and extends higher than the sidewalls 24, 26, then the upper shelf 34 preferably sits on the top of the cleat 36, or the bottom of the upper shelf 34 may be routed or otherwise provided with a suitable relief channel to receive the portion of the cleat 36 extending higher than the sidewalls 24, 26. In that manner, the shelf 34 is enabled to sit flush on top of the cleat 36 and the sidewalls 24, 26. Alternatively, if the sidewalls 24, 26 extend higher than the top of the cleat 36, then the shelf 34 preferably sits on the top of a portion of each of the sidewalls 24, 26 extending more than 2¾ inches rearward of the front of the vertical panels 18. The weight of the shelf 34 imparts a downwardly-directed force on the frame, which helps to further hold and stabilize the frame 20 within the cabinet system 12. Further, the upper shelf acts to close off and hide any void located behind the frame 20 between the vertical panels 18.

Any additional shelves 14 of the cabinet system 12 that are positioned above the upper shelf 34, i.e. in a region extending a distance from the base plate 22 to a distal end of the ironing board 10 when in the substantially upright, stowed position shown in FIG. 1, should likewise have a front face 15 recessed at least approximately 2¾ inches from a front of the vertical panels 18. The distance of 2¾ inches from the front of the vertical panels 18 provides sufficient clearance for the ironing board 10 to be received between the vertical panels 18 when the ironing board 10 is folded up to the substantially upright, stowed position shown in FIG. 1. That distance will vary, depending on the thickness dimension needed to accommodate the ironing board 10 when in the substantially upright, stowed position.

The frame 20 is preferably secured to the vertical panels 18, for example by drilling installation holes at one or more locations along each of the sidewalls 24, 26 to receive securement screws which extend through the sidewalls 24, 26 and into the adjacent respective vertical panels 18. As an alternative example, holes may be drilled through the vertical panels 18, to receive securement screws which extend through the vertical panels 18 and into the adjacent respective sidewalls 24, 26.

Figure 4:
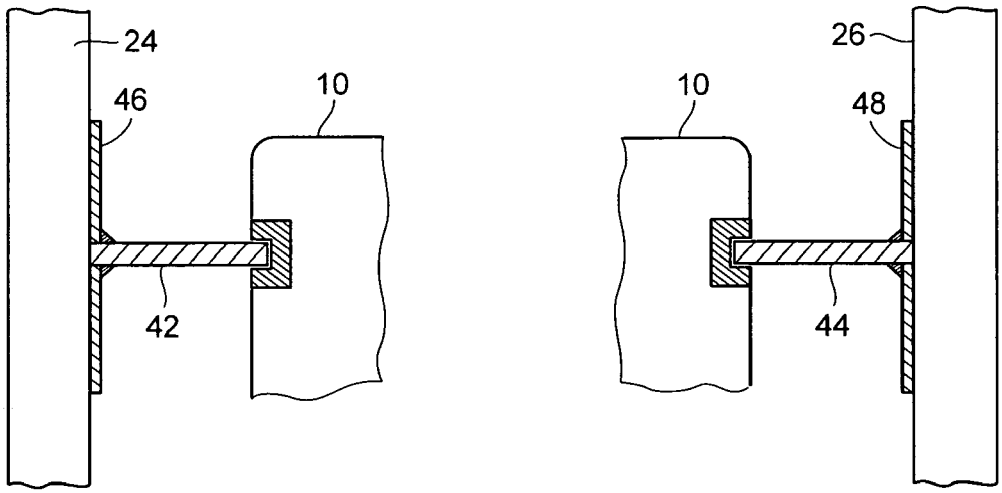
FIG. 4 is a top partial cross-sectional view of a variation of the first embodiment, wherein a first rod portion and a second rod portion are used to mount the ironing board to the frame.

An axle rod 40 extends between the sidewalls 24, 26 of the frame 20. The axle rod 40 also extends through a first end 11 of the ironing board 10, serving as a pivot axis for moving the ironing board 10 to the substantially upright, stowed position shown in FIG. 1, and to the substantially flat operating position shown in FIG. 2. The axle rod 40 preferably spans the entire distance between the sidewalls 24, 26. However, it will be appreciated by those of ordinary skill that the axle rod 40 may include a first rod portion 42 secured to sidewall 24, and a second rod portion 44, coaxial with the first rod portion 42, secured to the sidewall 26, with the ironing board 40 associated with both the first and second rod portions 42, 44, even if the rod portions are not connected. In other words, so long as there is adequate independent support for each of the first and second coaxial rod portions 42, 44, as shown in FIG. 4, the portions need not be part of a single, continuous rod 40.

Figure 5:
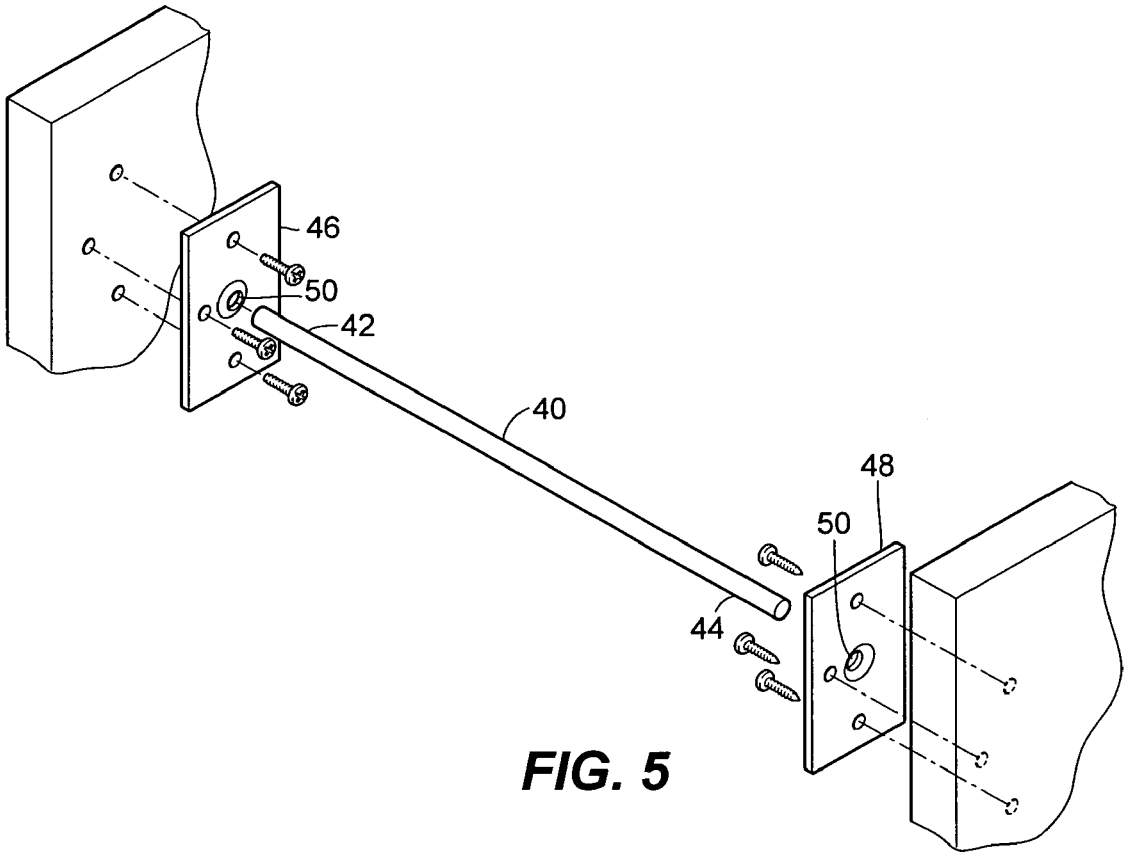
FIG. 5 is an exploded perspective view of an axle rod and plates used to mount the ironing board to the frame, with the ironing board omitted for clarity.

As shown in FIG. 5, the first and second rod portions 42, 44 are preferably connected to the sidewalls 24, 26 via plates 46, 48. The plates 46, 48 have rod-receiving apertures 50 and fastener-receiving apertures 52.

Figure 6:
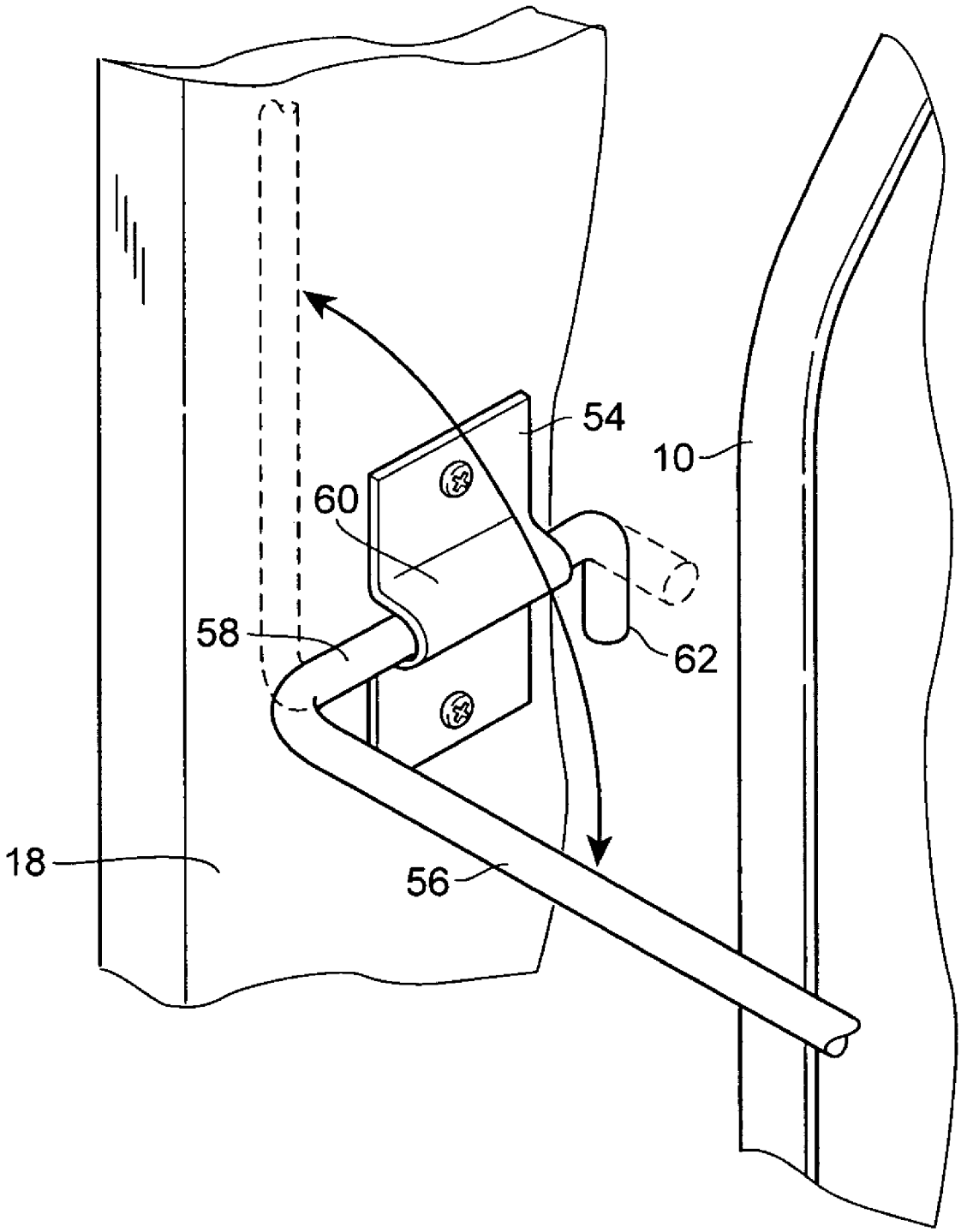
FIG. 6 is an enlarged perspective view of the area indicated at phantom line 6 of FIG. 1.
Figure 7:
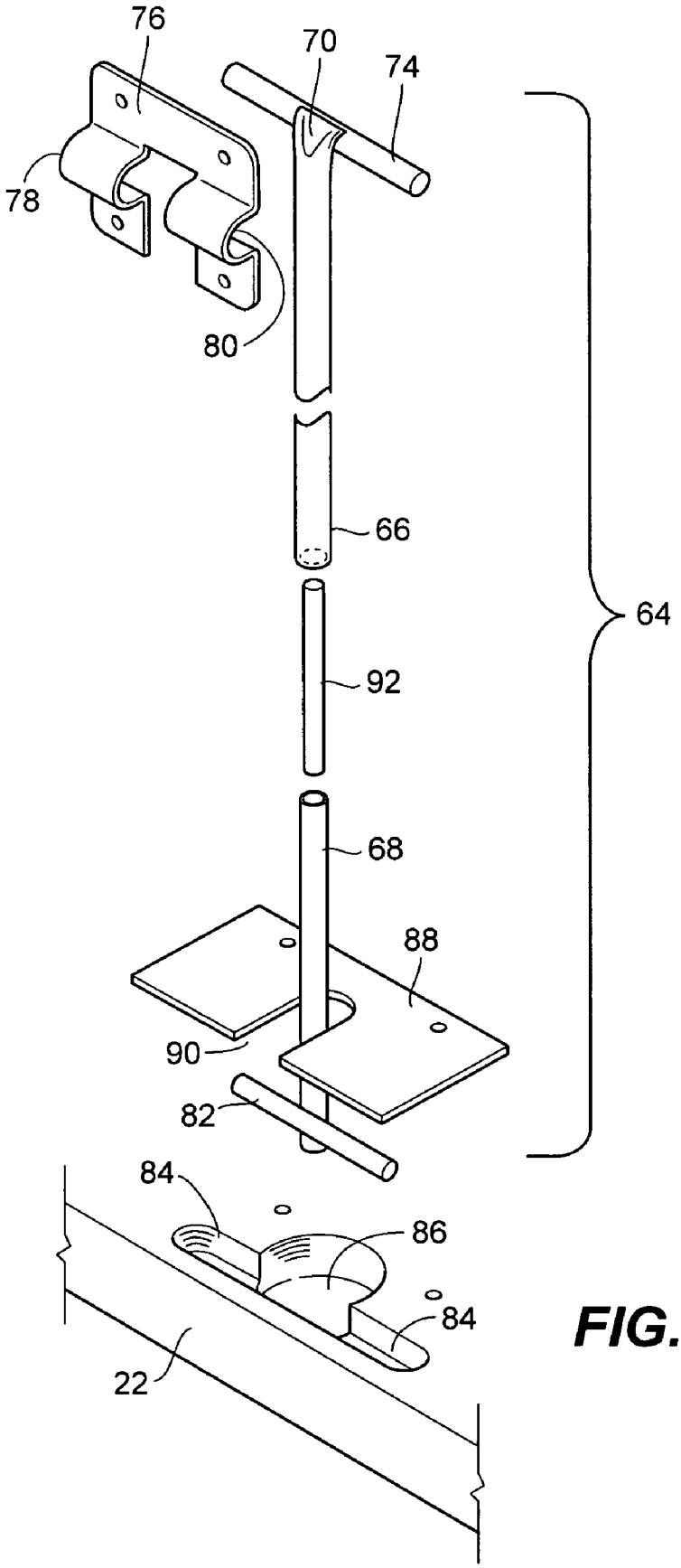
FIG. 7 is an exploded front perspective view of a telescoping support leg, and a broken-away portion of the baseplate of the frame, for the ironing board installation of the first embodiment.
Figure 8:
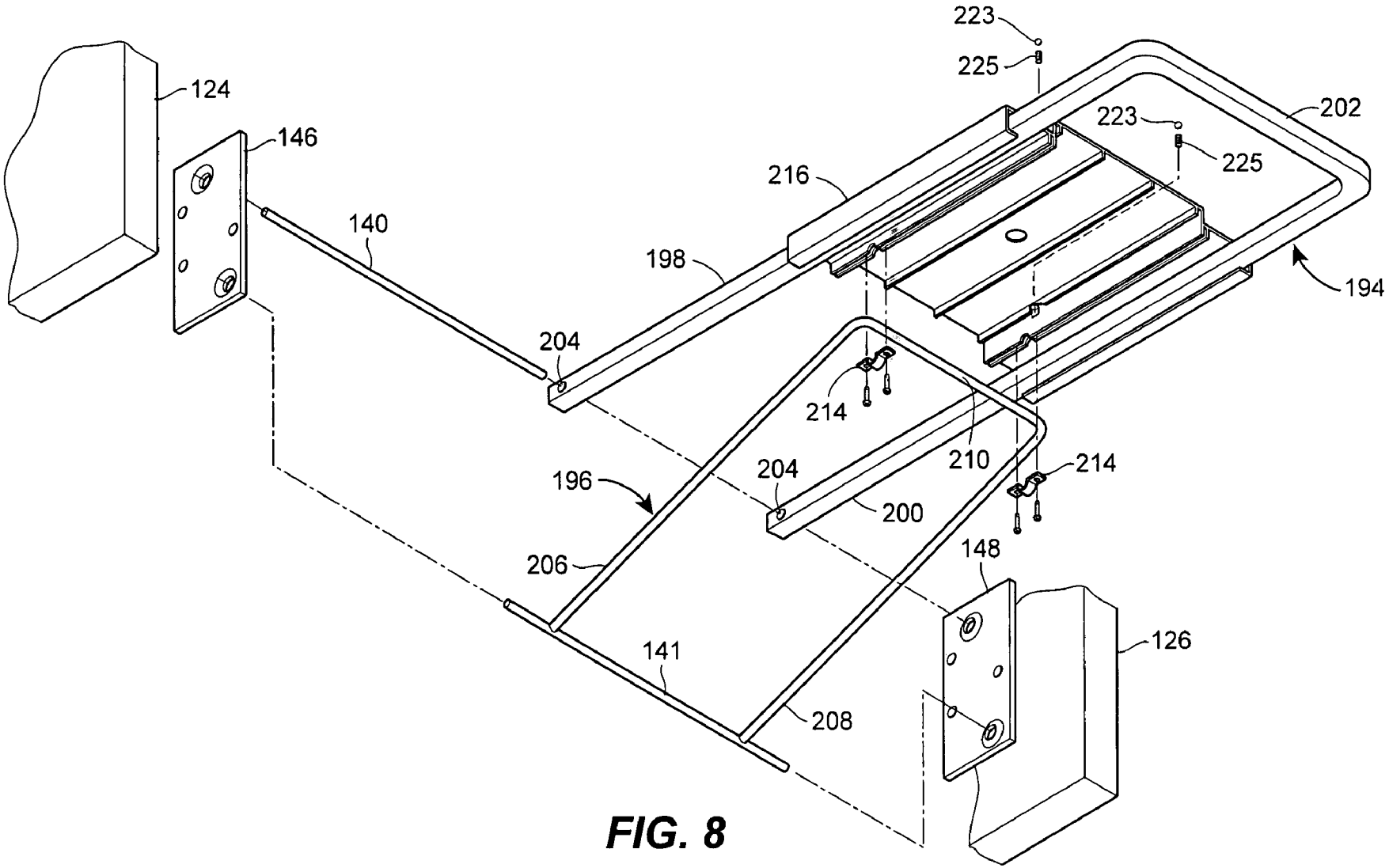
FIG. 8 is a partially exploded bottom perspective view of support structure for a second embodiment of a stowable ironing board installation in a frame, a broken away portion of which is shown, for mounting within a cabinet system.
Figure 9:
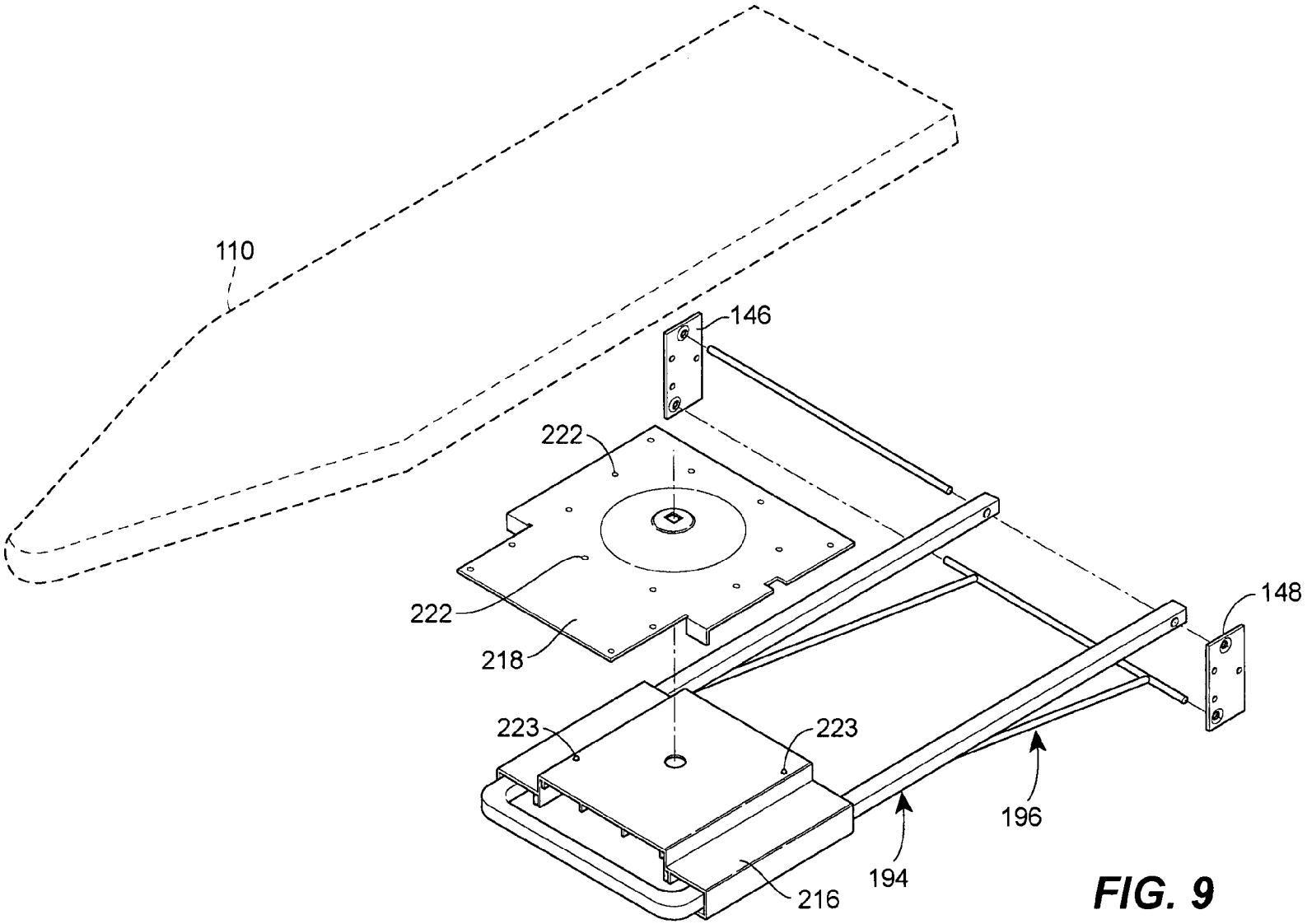
FIG. 9 is a partially exploded top perspective view of the support structure of the second embodiment shown in FIG. 8, with an ironing board shown in phantom lines.
Figure 10:
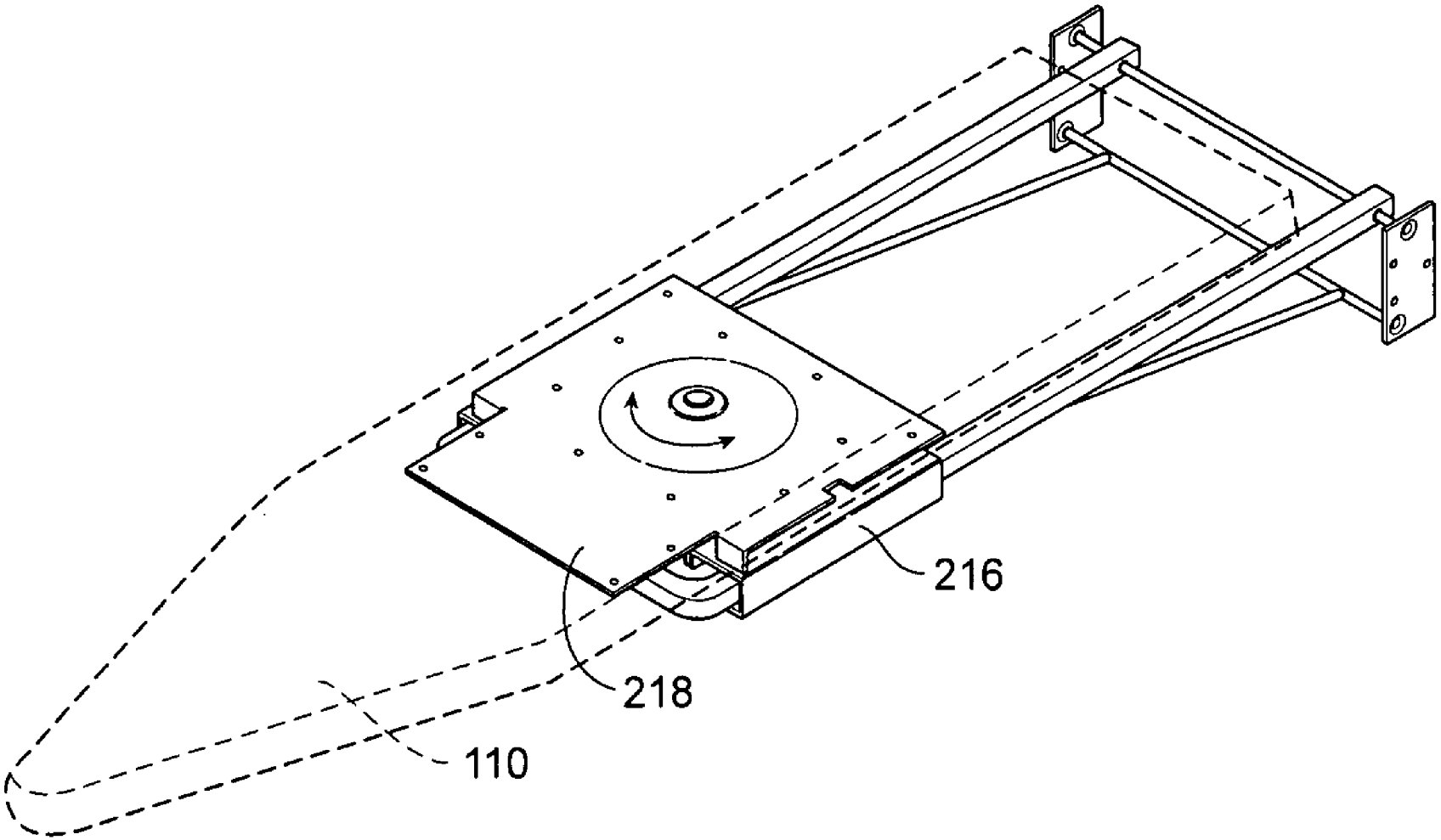
FIG. 10 is a perspective view of the support structure for the stowable ironing board installation of the second embodiment, with the ironing board shown in phantom lines in a substantially flat position.
Figure 11:
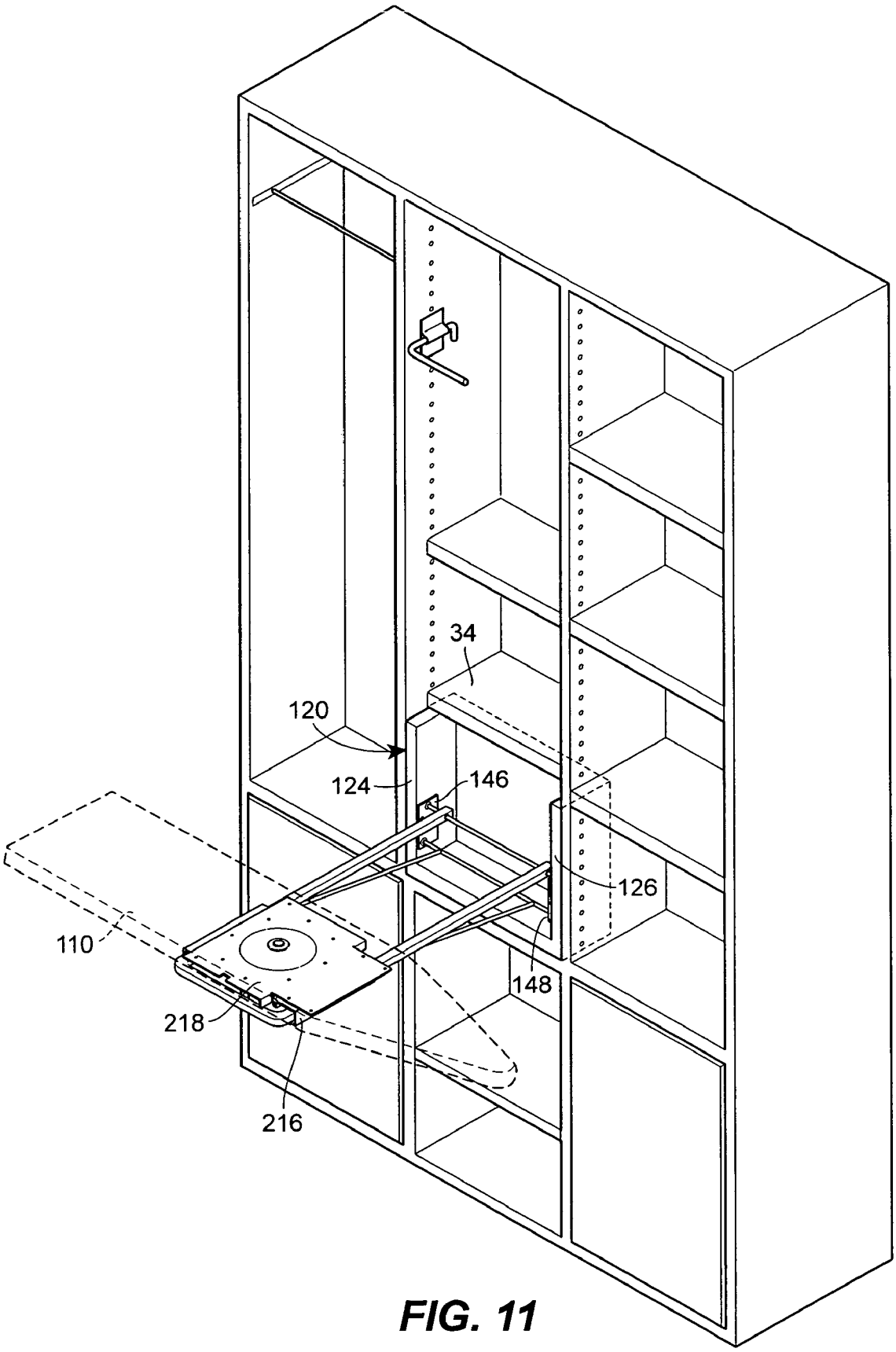
FIG. 11 is a perspective view similar to FIG. 10, but showing the ironing board, in phantom lines, swiveled on the support structure.

If desired, clamp 54 with a retainer bar 56 may be secured to one of the vertical panels 18, for locking the ironing board 10 in the substantially upright, stowed position, as shown in FIGS. 1 and 6. The retainer bar 56 is provided with a rearward extension 58, which extends through a generally U-shaped channel 60 in the clamp 54. A projection 62 of the rearward extension 58 makes contact with the vertical panel 18, which serves to lock the retainer bar 56 in a generally horizontal position. When the ironing board 10 is in the substantially upright, stowed position, and the retainer bar 56 is in the generally horizontal position, the retainer bar 56 prevents a second end 13 of the ironing board 10 from prematurely falling forward. To release the ironing board 10, the retainer bar 56 is rotated, as indicated by the arrow in FIG. 6, to an upright position shown in broken lines in FIG. 6.

A telescoping leg 64 is provided on an underside 15 of the ironing board 10 to provide stability when the ironing board 10 is in the substantially flat position for ironing. The telescoping leg 64 preferably includes a female tubular member 66 and a male rod 68. The female tubular member 66 has a crimped end 70 secured, such as by welding, to a first relatively short cylindrical member 74 oriented perpendicular to the female tubular member 66. A leg holding bracket 76, having generally U-shaped channels 78, 80, is used to movably secure the relatively short cylindrical member 76, and the first female tubular member 66 welded thereto, to the underside 15 of the ironing board 10.

The male rod 68 is welded at one end to a second relatively short cylindrical member 82. The base plate 22 includes routed coaxial grooves 84 oriented parallel to a front of the base plate 22, to receive the second relatively short cylindrical member 82. A bore 86 is also provided in the base plate 22. The bore 86 is deeper into the base plate 22 than the routed grooves 84, but does not extend through the base plate 22. The bore 86 is centrally disposed relative to the grooves 84. The grooves 84 and bore 86 receive the welded end of the male rod 68 and the second cylindrical member 82. A bracket plate 88 having an elongate opening 90 is secured, such as by screws, to the base plate 22 to movably retain the welded end of the male rod 68 and the second relatively short cylindrical member 82 within the routed grooves 84 and bore 86.

An elongate spacer rod 92 is provided within the hollow portion of the female tubular member 66, the spacer rod 92 being of such a length that when the ironing board 10 is moved to the substantially flat position for ironing, the male rod 68 contacts one end of the spacer rod 92, and the other end of the spacer rod 92 contacts an inside of the crimped end 70 of the female tubular member 66. When the ironing board 10 is substantially flat, the telescoping leg 64 thereby acts as a unitary rod in compression, providing adequate stability to the ironing board 10 during the rigors of ironing.

Unlike with prior stowable ironing board mounting arrangements, the relatively short rise of the frame 20 allows for storage on the shelves 14, 34 behind the ironing board 10, even when the ironing board 10 is in the substantially upright, stowed position. This now available storage space is particularly useful for accommodating ready-access ironing-related supplies in close proximity to the ironing board 10 when in the substantially flat position for ironing.

Turning to FIGS. 8–11, a second embodiment is shown in which the ironing board 110 is not only movable to a substantially upright, stowed position and to a substantially flat position, the ironing board 110 may also be swiveled. This swiveling maneuverability of the ironing board 110 facilitates even greater access to the increased storage space made available behind the ironing board 110 within the cabinet system 112 provided by the short rise of the frame 120, as well as makes for, in effect, a compact ironing center when the present ironing board installation is mounted to a solid shelf closet or cabinet system. Where elements referenced with respect to the ironing board installation of this second embodiment are the same or substantially the same as corresponding elements in the first embodiment described above, like reference numbers are utilized, increased by 100, and a detailed description of such elements with respect to this second embodiment is omitted, as unnecessarily duplicative.

The ironing board 110 is able to swivel so that the ironing board 110 does not have to only extend perpendicularly (in a horizontal plane) to the front of the cabinet system 112. Because of floorspace constraints in laundry rooms, hotel rooms, dressing rooms, bedroom closets, hall closets, dormitory rooms, studio or efficiency apartments, or other spaces where stowable ironing boards are typically installed, it is advantageous to have the ability to move the ironing board 110 when in its substantially flat position, to an orientation parallel to the front of the cabinet system 112, or to some angle in between 0° and 90°, in a generally horizontal plane, with respect to the front of the cabinet system 112.

When the ironing board 110 is swiveled to an orientation away from 90°, in the generally horizontal plane, with respect to the front of the cabinet system 112, it is significantly easier for a person to reach the storage space above the ironing board which has now been made accessible and usable by virtue of the present disclosure.

The ironing board 110 may be indirectly mounted to the sidewalls 124, 126 of the frame 120, using a support structure, in the following manner. An upper leg hoop 194 has a generally U-shaped appearance, with two elongate leg portions 198, 200, and an intermediate leg portion 202. Each of the two elongate leg portions 198, 200 is provided with horizontal apertures 204 therethrough at an end opposite the intermediate leg portion 202. The upper leg hoop 194 may be formed, for example, as ¾ inch, 18 gauge, cold roll electric weld steel, square tubing, as shaped using a bender to preserve strength and avoid crushing. An axle rod 140 passes through the apertures 204 to movably secure the upper leg hoop 194 to plates 146, 148 secured, for example by screws, to the inside of the respective sidewalls 124, 126 of the frame 120.

A bottom leg hoop 196 is also movably mounted to the plates 146, 148. The bottom leg hoop 196 includes an axle rod 141, connected (such as by welding) to two elongate rods 206, 208 perpendicular to the axle rod 141, and an intermediate leg 210 opposite the axle rod 141. The bottom leg hoop 196 may be made, for example, of ½ inch, solid bar stock formed of cold roll 1018 steel. Mounting brackets, preferably in the form of metal straps 212, 214, each provided with a channel to receive the intermediate leg 210, are used to movably secure the bottom leg hoop 196 to a shaped support piece 216, preferably made of extruded aluminum. In this embodiment, the shaped support piece 216 is constrained against movement in a horizontal direction, i.e. it does not move in a direction parallel to the front of the cabinet system.

The shaped support piece 216 is rotatably secured, such as with a nut and bolt, to an underside of a swivel plate 218, on which the ironing board 110 may swivel. The swivel plate 218 is preferably a metal sheet with a convex, dome-like region 220 facing upward, and the swivel plate 218 is fixed to the bottom of the ironing board 110. A plurality of holes 222 are provided in the metal sheet of the swivel plate 218 to receive at least two ball bearings 223 which ride in between a bottom of the swivel plate 218 and a top side of the shaped support piece 216.

Each ball bearing is preferably biased by a spring 225 in compression, which spring extends through the shaped support piece 216, toward the bottom of the swivel plate 218. As the ironing board 110 and swivel plate 218 swivel to a position at which the ball bearings come into alignment with the holes 222, the spring-biased ball bearings are pushed up and into the holes 222, inhibiting further swiveling of the ironing board 110. In this manner, the holes 222 serve as temporary stops, but these stops may be overcome by applying pressure sufficient to the ironing board 110 to overcome the biasing force of the springs and to push the ball bearings back down and out of alignment with the holes.

Figure 12:
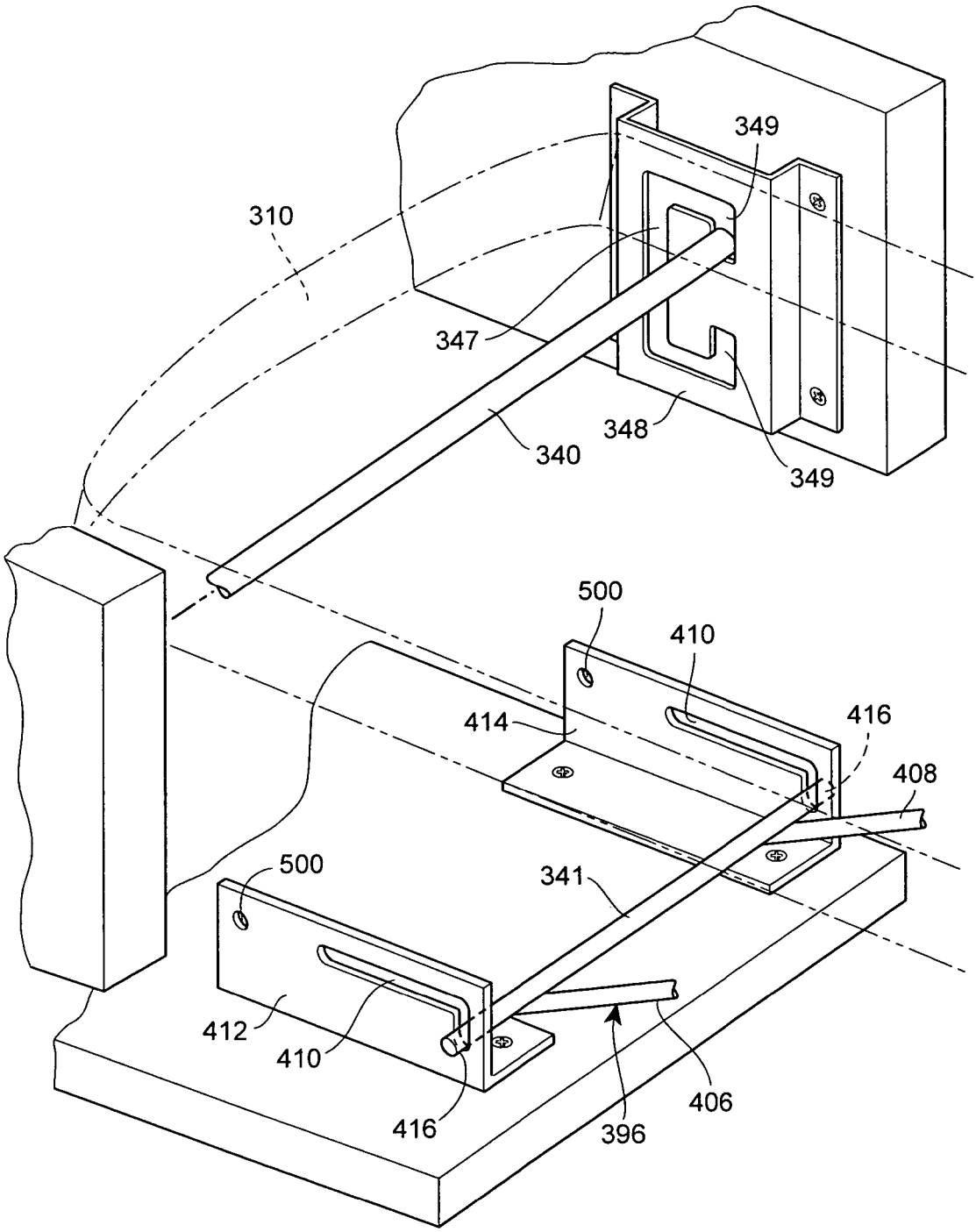
FIG. 12 is perspective view, partially broken away, of a stowable ironing board installation according to a third embodiment with the ironing board shown in phantom lines for clarity, wherein the stowable ironing board is height-adjustable.
Figure 1:
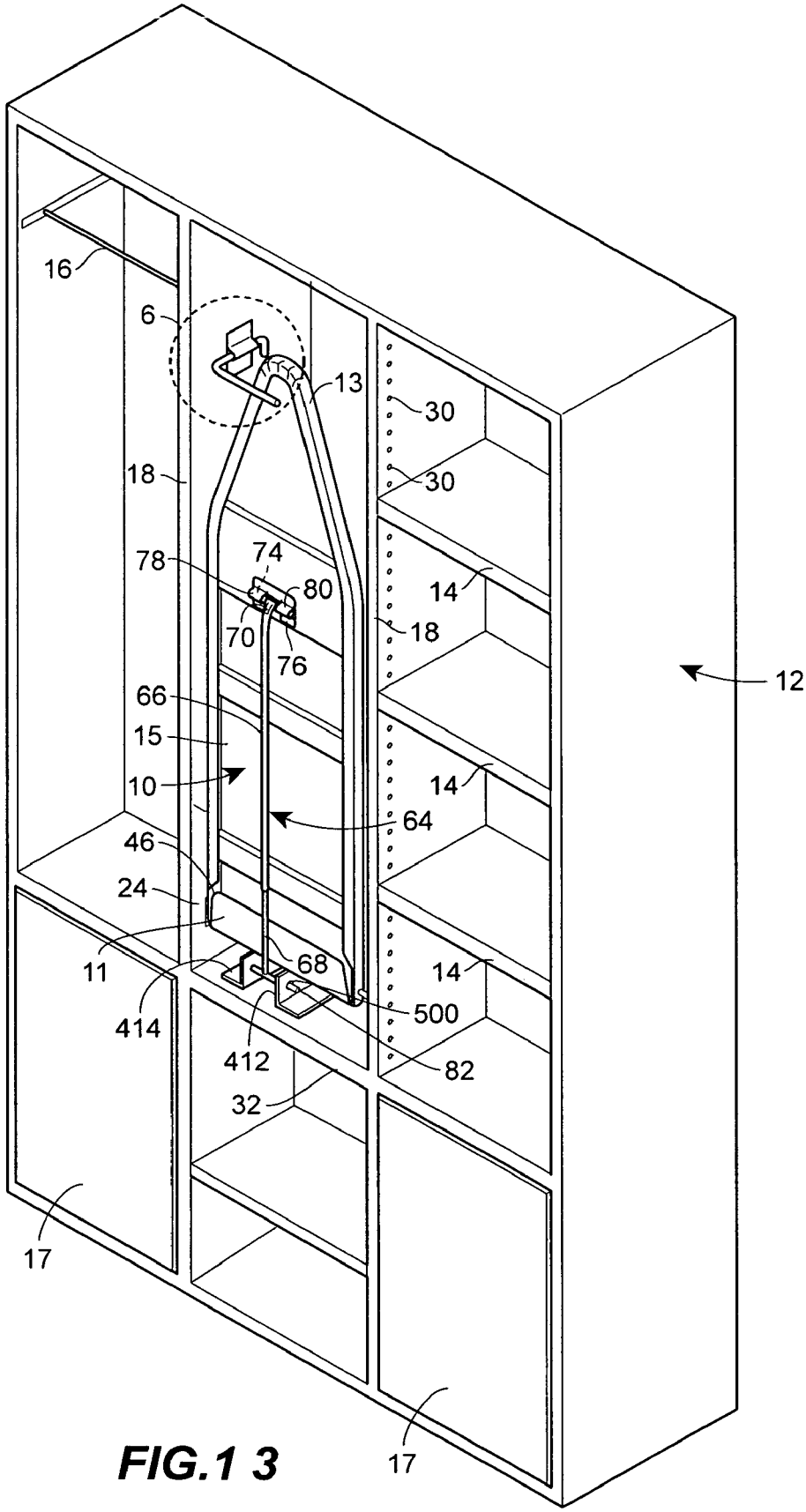

In a third alternate embodiment, shown in FIG. 12, the stowable ironing board installation incorporates an ironing board 310 that is not only stowable, but is also height-adjustable. To facilitate height adjustment, an axle rod 340 associated with the ironing board 310 is mounted to plates 346, 348 secured to the respective sidewalls 324, 326 of the frame. Each plate 346, 348 has an elongate vertical channel portion 347 therein to permit and bound movement of the axle rod 340. The elongate vertical channel portion 347 terminates at its upper and lower ends at end stops 349, giving the overall channel of each of the plates 346, 348 a generally C-shaped appearance. This C-shape reduces manufacturing costs by permitting mounting of the plates 346, 348 to either sidewall 324, 326, since only the uppermost end stop 349 is used. The axle rod 340 preferably passes through the ironing board 310.

A lower leg structure 396, which may be similar to the lower leg hoop 196 of the second embodiment described above, is also provided, including an axle rod 341, and two elongate rods 406, 408. It will be understood that, as an alternate to the use of two elongate rods 406, 408, a single rod may be employed, together with one or more appropriate complementary brackets. The lower leg structure 396 may be secured to an underside of the ironing board 310 by brackets such as the metal straps 212, 214 described and shown above with respect to the previous embodiment. To complete vertical movement of the ironing board 310 and preserve the substantially flat orientation of the ironing board 310, the position of the lower leg structure 396 is also adjustable. To facilitate and control the range of movement of the lower leg structure 396, the axle rod 341 rides within elongate channels 410 provided in L-shaped bottom plates 412, 414. The elongate channels 410 extend depth-wise when the plates 412, 414 are installed on the base plate 422. The elongate channels 410 terminate at the front in a downwardly-extending channel end 416, which serves to catch the axle rod 341 at the forward end of its travel.

The elongate vertical channel portion 347 preferably has a length of about 4 inches, so that the ironing board may be adjusted from an initial "default" height upon moving the ironing board 310 down from its stowed position to the substantially flat position, to a second height, preferably approximately 4 inches lower than the initial default height. The elongate channels 410 preferably have a length of approximately 2 inches.

In order to adjust the ironing board 310 from its initial default height, to its lower second height and place the ironing board 310 in a substantially flat orientation for ironing, it is necessary to first raise the rear or first end 311 of the ironing board 310 to pull the axle rod 340 up and out of the upper end stops 349, then move the ironing board 310 rearward and down so as to move the axle rod 340 down to the bottom of the elongate channels 410. Next, it is necessary to raise a front or second end 313 of the ironing board 310 in order to lift the axle rod 341 up and out of the channel ends 416 and into alignment for rearward movement along the elongate channels 410, and to allow the axle rod 341 to slide to the rear of the elongate channels 410.

Figure 14:
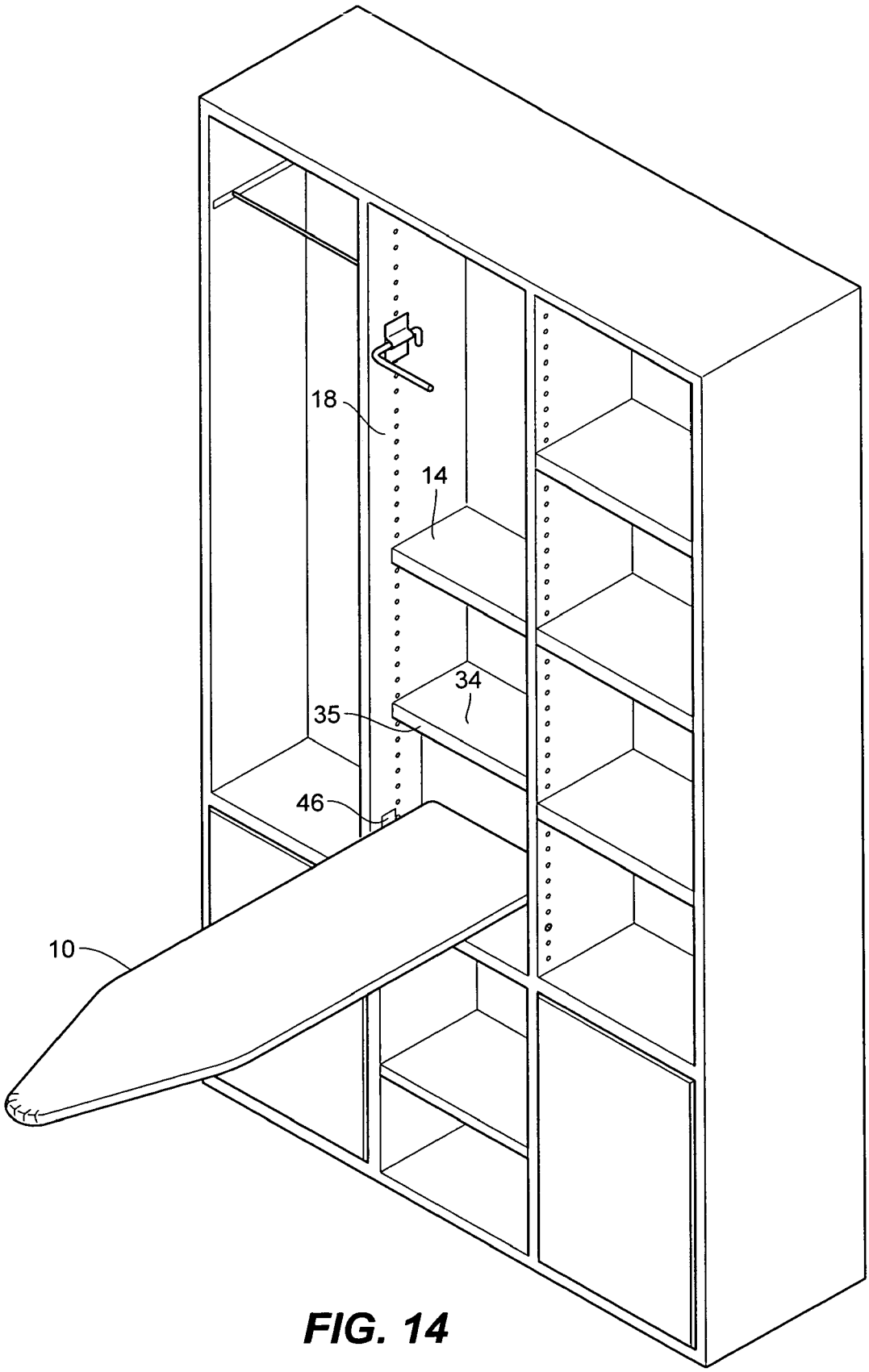
FIG. 14 is a front perspective view of the stowable ironing board installation of FIG. 13, with the ironing board shown in a substantially flat position.

In a variation of the stowable ironing board installation of the first embodiment, shown in FIGS. 13 and 14, the structure of the mounting frame 20 is omitted. Thus, the plates 46, 48 are mounted directly to the vertical panels 18 of the cabinet system 12. It is possible for the grooves 84 to be routed directly into the permanent shelf 32, and bore 86 is drilled directly into, or otherwise formed in, the lower shelf 32, if the thickness of the permanent shelf 32 permits. However, it is preferable in such an embodiment to instead utilize a pair of L-shaped brackets, such as bottom plates 412, 414 having apertures 500 to receive the cylindrical member 82 at the end of male rod 68 of the telescoping leg 64.

Figure 15:
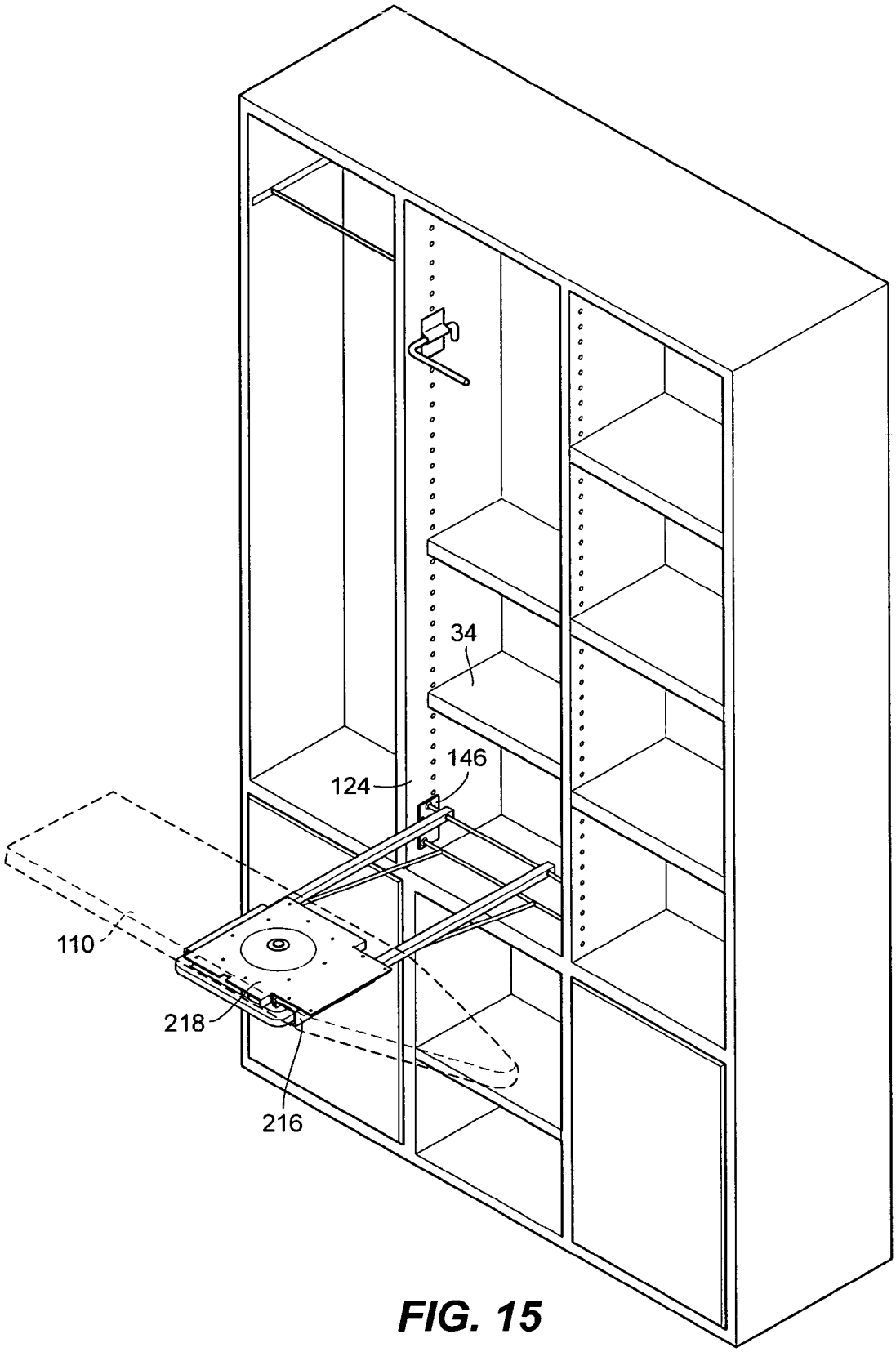
FIG. 15 is a front perspective view of a modification of the ironing board installation shown in FIGS. 8–11, wherein the support structure for the stowable ironing board is mounted directly into a cabinet system without the use of a frame, showing the ironing board, in phantom lines, in a substantially flat position and swiveled on the support structure.
Figure 1:
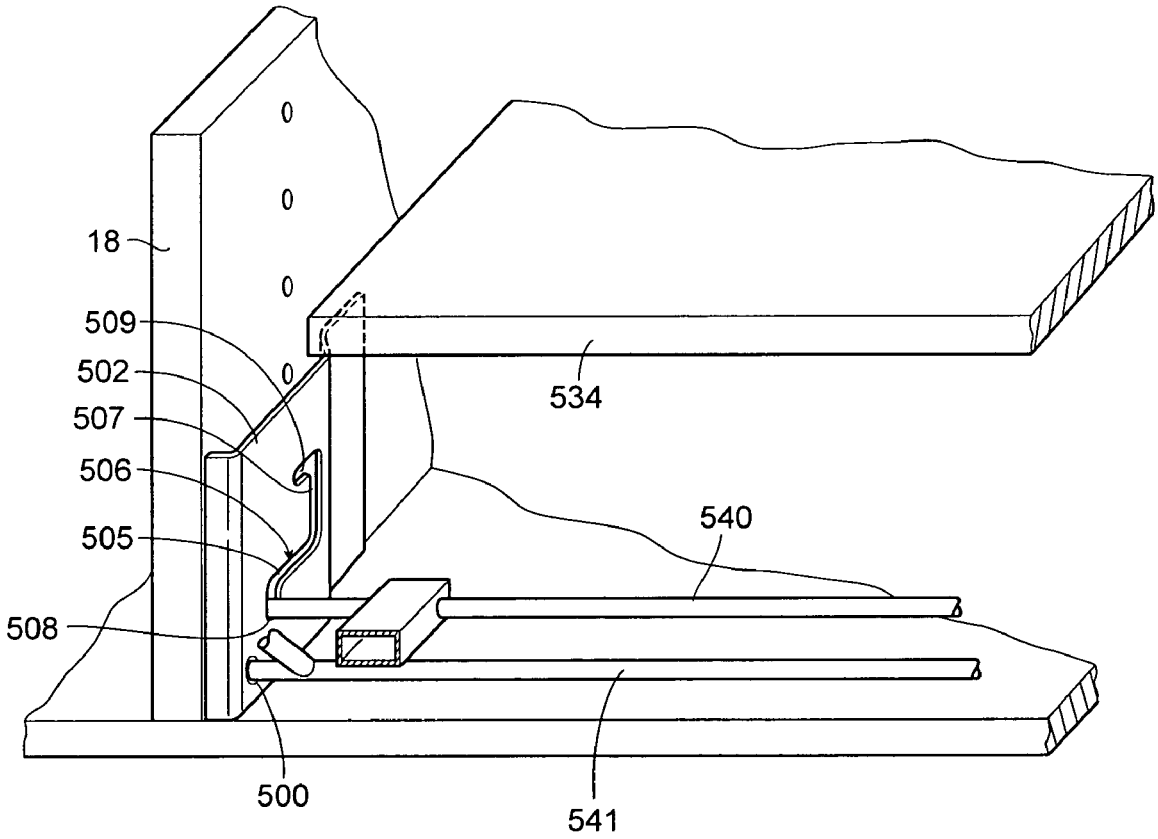

Turning to FIG. 15, a variation of the ironing board installation of the second embodiment is shown, wherein the mounting frame 120 is omitted. In this manner, the support structure for the stowable ironing board installation, with the swivel feature, is mounted directly to the vertical panels 18 of the cabinet system 12. In this manner, the entire area behind the ironing board when in a substantially upright, stowed position is available for storage. As in the other embodiments and variations, shelves having a front face recessed away from the front of the cabinet system to accommodate the ironing board may be employed, at least in a region higher than the axle rod 140, for on-shelf storage of items.

It will be appreciated by those of ordinary skill in the art that the third embodiment may likewise be modified to omit the structure of the frame 20 in ironing board installations according to the present disclosure in which the ironing board may be height-adjustable, without being mounted in a frame.

In a fourth alternate embodiment, the ironing board may be swiveled and is also height adjustable. To accomplish both the swiveling ability and height adjustability in a single installation, it is preferable to use a pair of bracket plates 502 mounted to the side walls of the frame or to the vertical panels 18 of the cabinet system. One such bracket plate 502 is shown in FIG. 16, the other of which is a mirror image thereof. The bracket plates 502 each include an aperture 504, which receives a lower axle rod 541 of the support structure. A generally L-shaped channel track 506 is also provided in each of the bracket plates 502. The generally L-shaped channel track 506 has an elongate, generally horizontal segment 505 and an elongate, generally vertical segment 507. The generally vertical segment 507 preferably has a length of about 4 inches to allow about a 4 inch range between an initial (or default) lower position to a higher position. At a forward end of the horizontal segment 505 is a relatively short, downwardly-extending first channel end 508. Similarly, at the top of the vertical segment 507 is a relatively short, forwardly-extending second channel end 509. This channel track 506 receives an upper axle rod 540 of the support structure. The manner in which the support structure engages the ironing board is omitted from the drawing for clarity, but a similar engagement has been described above with respect to the second embodiment.

The brackets 502 may be mounted in a frame, or, as shown in FIG. 16, directly to vertical panels 18 of a cabinet system. When the ironing board of this embodiment is deployed from its substantially upright, stowed position to a substantially flat orientation, the axle rod 540 is in the downwardly-extending first channel end 508, so the ironing board is initially in the lower position.

To raise the ironing board to the higher position, a first end of the ironing board is lifted to bring the axle rod 540 up, out of the first channel end 508, and into alignment with the generally horizontal segment 505. The axle rod 540 is pushed rearwardly (which may be facilitated by lifting a second end of the ironing board) until in alignment with the generally vertical segment 507. The axle rod 540 is then lifted up the length of the vertical segment 507 by lifting at least the first end of the ironing board, until the axle rod 540 received in the second channel end 509, thereby securing the ironing board into a raised, substantially flat position for ironing. At least one shelf 534 may also be mounted between the vertical panels 18 to make use of the available storage area behind the ironing board and support structure.

While the present disclosure has described various embodiments, it is intended that variations may be made to these embodiments without departing from the scope of the appended claims.

What is claimed as new and desired to be protected by Letters Patent of the United States is:

1. An installation for a stowable ironing board comprising:

an ironing board;

a frame including a rear wall, a pair of parallel wall members, and a cross member, the parallel wall members spaced apart from one another a distance greater than a width of the ironing board and the cross member extending between the parallel wall members;

a shelf disposed on the frame and extending rearward from the frame, in a direction opposite the ironing board;

a first axle rod portion engaging one of said parallel wall members; and a second axle rod portion engaging the other of said parallel wall members;

the ironing board being selectively movable to a substantially upright, stowed position and to a substantially flat position, the ironing board having a first end receiving the first and second axle rod portions, and a second end;

said frame being of a height substantially less than a length of the ironing board to permit access to storage space behind the ironing board when in the substantially upright, stowed position;

said cross member being disposed in front of the rear wall of the frame and allowing clearance for the ironing board when in the substantially upright, stowed position; and said shelf having a depth allowing clearance for the ironing board in front of the shelf when the ironing board is in substantially upright, stowed position.

2. The installation of claim 1, wherein a top of the cross member is flush with a top of each of the parallel wall members.

3. The installation of claim 1, further comprising a shelf disposed on the cross member, said shelf having a weight imparting a downwardly-directed force on the frame to help stabilize the frame.

* * * * *